United States Patent [19]

Seidel

[11] Patent Number: 4,922,634

[45] Date of Patent: May 8, 1990

[54] SKI BOOT

[75] Inventor: Sigurd Seidel, Graz, Austria

[73] Assignee: Raichle Sportschuh AG, Kreuzlingen, Switzerland

[21] Appl. No.: 287,384

[22] Filed: Dec. 20, 1988

[30] Foreign Application Priority Data

Dec. 22, 1987 [CH] Switzerland ..... 4989/87

[51] Int. Cl.[5] ..... A43B 5/04

[52] U.S. Cl. ..... 36/119; 36/58.5

[58] Field of Search ..... 36/117–121, 36/50, 58.5; 24/68 SK

[56] References Cited

U.S. PATENT DOCUMENTS

| | | | |
|---|---|---|---|
| 4,654,985 | 4/1987 | Chalmers | 36/117 X |
| 4,724,626 | 2/1988 | Baggio | 36/117 |
| 4,802,291 | 2/1989 | Sartor | 36/119 |
| 4,811,503 | 3/1989 | Iwama | 36/119 |

FOREIGN PATENT DOCUMENTS

| | | | |
|---|---|---|---|
| 0221483 | 5/1987 | European Pat. Off. . | |
| 297056 | 12/1988 | European Pat. Off. | 36/117 |
| 3506056 | 3/1986 | Fed. Rep. of Germany | 36/117 |
| 668165 | 12/1988 | Switzerland | 36/117 |

*Primary Examiner*—James Kee Chi

*Attorney, Agent, or Firm*—Collard, Roe & Galgano

[57] ABSTRACT

There is provided a ski boot wherein a support element in the interior of the boot shaft acts on an inner boot in the area of the skier's instep. A pulling element forms a first partial loop which is guided across the front end region of the support element and extends from there against the sole of the boot and is reversed in the sole in a way such that its segments run into an adjustment nut from the back. A second partial loop is guided across the top end region of the support element and extends to guide elements of a heel cap and is guided from there with an intersection or cross-over to the adjustment nut. The nut is seated on a spindle which is rotatable by means of an adjusting motor. By displacing the nut in the lengthwise direction of the boot toward the toe, the size of the two partial loops is reduced, permitting the support element and the heel cap to come to rest against the inner boot and the latter to come to rest against the foot. By moving the nut in the direction of the heel, the size of the two partial loops is enlarged, permitting the skier to step into and out of the ski boot without difficulty.

16 Claims, 2 Drawing Sheets

SKI BOOT

The present invention relates to a ski boot with a shaft portion and a sole, a support element arranged in the interior of the shaft portion covering the instep of the skier's foot in the nature of a saddle, and a pulling element adapted to be tensioned and released by a driving arrangement. The pulling element is guided across the front end region of the support element, extends in the direction of the sole and acts on the support element in the top end region thereof, pulling the support element rearwardly.

A ski boot of this type is disclosed in U.S. Pat. No. 4,724,626, to baffio, granted Feb. 16, 1988. In the interior of the shaft portion of the ski boot according to this European patent document, a support element is arranged covering the instep of the skier's foot in the form of a saddle, and a heel cap grips around the heel of the skier's foot from the back, the heel cap forming a single piece with the support element. Thus, the support arrangement grips around the heel, a first side of the foot on the inside thereof, as well as the instep. On the second side of the foot opposite the first side, a loop formed at the end of the pulling element is fixed on the support element in the top end region. This loop extends along the second side of the foot to the heel cap and around the latter and terminates on the first side of the foot, whereat the pulling element is reversed in the direction of the sole and extends from there via the front end region of the support element to the driving arrangement where it is fixed on a drum. When the pulling element is wound on the drum, the support element is pulled toward the heel cap in the region of the loop on the second side of the foot and in the front end region the support element is tightened against the sole. To release the pulling element, the drum is turned in the opposite direction. With this ski boot, an optimal adaptation of the support element in the top end region is possible only in dependence on the front end region, because the force required for pulling back the support element in the direction of the heel cap is transmitted by the support element to its front end region. Furthermore, the forces acting on the foot are asymmetrical and the friction between the pulling element, the heel cap and the support element may lead to distortions of the support arrangement.

The object of the present invention is to provide a ski boot in which the support element is tightened in the front end region thereof against the sole, and in the top end region thereof against the heel, so that the forces to act on the support element substantially symmetrically relative to the lengthwise direction of the boot, and the adaptation of the support element to the skier's foot in the top end region is less dependent upon its adaptation to the foot in the front end region.

The above object is accomplished in accordance with the present invention by forming the pulling element into two partial loops actively connected with the driving arrangement, the first loop being guided across the front end region of the support element and the second loop being guided across the top end region of the support element, the lengths of the loops being simultaneously extended and reduced by the driving arrangement.

In a preferred embodiment of the present invention, the two partial loops are formed of a single closed loop and the driving arrangement divides the single loop into the two partial loops and acts on the pulling element between the two partial loops. If the length of the closed loop is adjustable, the support element can be adapted to any shape of foot.

According to a further embodiment of the present invention, the two partial loops are guided to a pulling part in such a way that the two partial loops are jointly reduced or enlarged in size. Thus, the driving arrangement may be embodied in a particularly simple way.

In still a further embodiment of the present invention, the pulling part has a nut seated on a rotatably supported spindle preferably arranged in the sole, with the axis of rotation of the spindle extending substantially parallel with the segments of the partial loops. In this way, a large force acting on the support element can be produced by expending a relatively low force in rotating the spindle. Thus, the spindle can be driven by means of an electric motor or by means of a rotary wheel, the latter being actively connected with the spindle by means of a flexible shaft and actuated from the exterior of the boot.

In a particularly preferred embodiment of the invention, the pulling element extends in the region of the second partial loop from the top end region of the support element along both sides of the foot and to a heel cap gripping around the heel from the rear, and then to the driving arrangement after an intersection or crossover within the area of the heel cap. This embodiment gives the skier's foot good support especially crosswise, relative to the lengthwise direction of the boot. If the heel cap is elastically deflectable in a direction substantially parallel with the sole and transverse relative to the lengthwise direction of the boot, the heel cap is forced against the foot laterally in the region of the heel, thereby enhancing the support even more.

The length of the closed loop can be adjusted in a particularly simple manner if the pulling element is separated and fixed at its one end on the support element and actively connected at its other end with a length adjustment element arranged on the support element.

In yet another embodiment of the present invention, a strap or bracket whose spacing from the support element is adjustable in a direction substantially transverse to the sole grips over the support element between the front and top end regions thereof in a plane extending substantially transversely relative to the lengthwise direction of the boot. The pulling element is guided from the driving arrangement to guides in the lateral ends of the strap and thence in the direction of the sole to a reversing point, and thence around the front end region of the support element. Thus, the force acting on the support element is distributed over three areas, so that while the pulling element forms a closed loop, whose length is not adjustable, the support element can always be pulled against the instep with sufficient force, irrespective of the anatomy of the skier's foot.

Other objects and features of the present invention will become apparent from the following detailed description considered in connection with the accompanying drawings. It is to be understood, however, that the drawings are designed as an illustration only and not as a definition of the limits of the invention. In the drawings, wherein similar reference characters denote similar elements throughout the several views.

Figure 1:
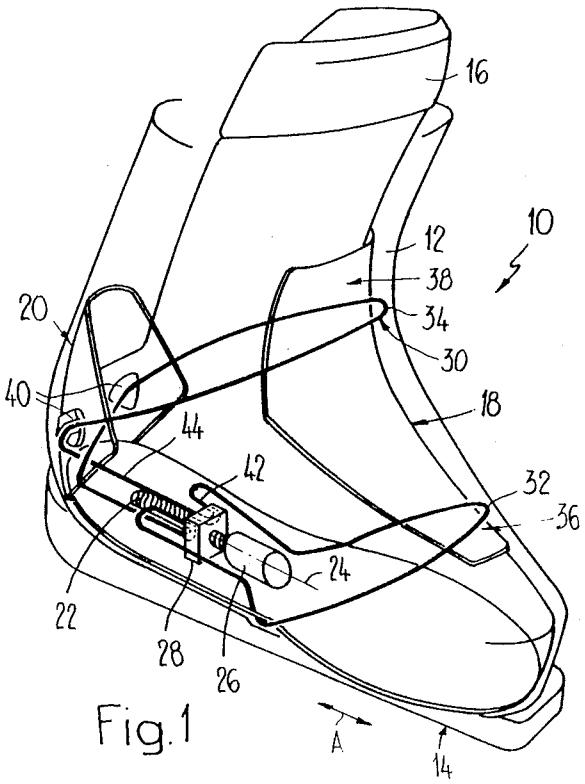
FIG. 1 is a perspective view of a ski boot in outline form showing the support element and heel cap adapted for actuation by means of a pulling element forming two partial loops in accordance with the present invention.
Figure 5:
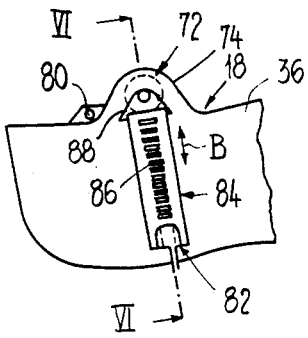
Figure 6:
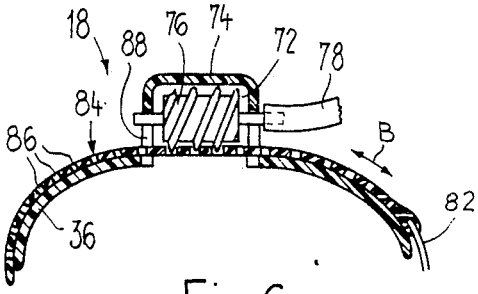

FIG. 5 is an enlarged top plan view of the front end region of the support element with a length adjustment element for adjusting the length of the pulling element forming a closed loop; and FIG. 6 is a cross-sectional view taken along line VI—VI of FIG. 5. Turning now to the drawings, there is shown in FIG. 1 a perspective view of a ski boot 10, having a shaft 12, a sole 14 and a cushioned inner boot or lining 16 arranged in the interior of the shaft. Shaft 12 and inner boot 16 are partially shown only in outline. Provision is made in the interior of shaft 12 for a support element 18 covering the inner boot in the area of the instep of the skier's foot, and, in the area of the heel, for a heel cap 20 arranged on sole 14, said cap gripping around the skier's heel from the rear and acting on inner boot 16. A stationary spindle 22 is rotatably supported in sole 14, with its lengthwise axis 24 extending parallel with the lengthwise direction A of the boot. The shaft of an adjusting motor 26 is torsionally rigidly connected with spindle 22. The adjusting motor is electrically connected to a battery or an accumulator (not shown) arranged, for example, in the boot, by means of a switching element (not shown). A nut 28 is seated on spindle 22 and is displaceably, yet positively, supported in sole 14, with displacement in the lengthwise direction A of the boot. A pulling element 30 is guided in the interior of ski boot 10 in a way such that it forms two partial loops 32 and 34. Partial loop 32 grips over support element 18 in its front end region 36 and is guided on both sides of the front part of the skier's foot to sole 14, where it is reversed. Partial loop 32 then extends in sole 14 approximately parallel with the length-wise direction A of the boot on both sides of adjusting motor 26 and past nut 28 to the heel region of ski boot 10, where it is again reversed extend parallel with the lengthwise direction A of the boot back to nut 28. The second partial loop 34 is guided in top end region 38 of support element 18 around the latter and extends on both sides of the skier's foot to guide elements 40 laterally arranged on heel cap 20. Pulling element 30 extends from each guide element 40 in each case around heel cap 20 to the other side of ski boot 10, so that the strands intersect or cross-over one another in the area of heel cap 20, and extend from there approximately parallel with the lengthwise direction A of the boot in sole 14 to nut 28. Pulling element 30 is twice reversed in the nut by 180° as shown by the dashed lines, so that a segment 42 of partial loop 32, said segment extending substantially parallel with the lengthwise direction A of the boot, is connected in each case with a corresponding segment 44 of partial loop 34. Consequently, pulling element 30 forms a single closed loop, which is guided in such a way that two partial loops 32 and 34 are formed, which are simultaneously enlarged or reduced by displacing nut 28 in the lengthwise direction A of the boot. For adapting the size of the two partial loops 32 and 34 to the individual anatomy of the skier's foot, pulling element 30 is slidingly guided in nut 28 in each case.

Figure 2:
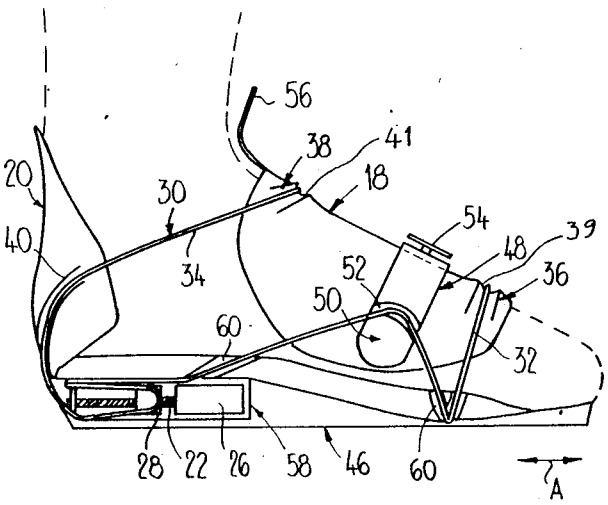
FIG. 2 is a side elevational view of a ski boot shown without its shaft, having a support element and a heel cap similar to FIG. 1, wherein the support element is gripped by a strap extending thereacross, and the pulling element is guided around the lateral ends of the strap.

FIG. 2 shows neither shaft 12, nor sole 14, nor inner boot 16 of boot 10. The foot of the skier is indicated by dashed lines. For the sake of clarity, only the parts arranged in the interior of boot shaft 12 and in sole 14 are shown. Support element 18 covers the area of the skier's instep in the manner of a saddle, and heel cap 20, which is elastically deflectable in the lengthwise direction A of the boot, is fastened on a wedge 46 arranged in sole 14. Between the front and top end regions 36 and 38 of support element 18, a strap 48 grips across support element 18 in the form of a "U". Guides 52 for pulling element 30 are arranged in lateral ends 50 of strap 48, which, viewed in the lengthwise direction A of the boot, extend downwardly on both sides of support element 18. A set screw 54 having its free end supported on support element 18 is supported in the center of strap 48 between ends 50. Set screw 54 has a flat, large-sized head, so that the screw can be easily turned by hand. The spacing between strap 48 and support element 18 crosswise relative to the sole 14 is adjustable by means of set screw 54.

In top end region 38 of support element 18, there is provided an elastic flap 56 directed toward the skier's shin, by means of which support element 18 is fixed on boot shaft 12 (not shown in FIG. 2). In the top and front end regions 38 and 36 of support element 18, pulling element 30 is supported in guides 41 and 39, respectively, molded on support element 18. Similar laterally positioned guide elements 40 are molded on heel cap 20, which is elastically deflectable in a direction substantially parallel with sole 14 and transverse relative to the lengthwise direction A of the boot (see also FIG. 1).

Provision is made for a driving arrangement 58 in wedge 46, such arrangement being comprised of spindle 22, adjusting motor 26 and nut 28. Wedge 46 is provided with recesses 60 for pulling element 30.

In the ski boot according to FIG. 2, pulling element 30 also forms first and second partial loops 32 and 34. First partial loop 32 is guided in guide 39 in front end region 36 of support element 18, it extends from guide 39 to wedge 46, is reversed in recesses 60, guided on both sides of the skier's foot to lateral guides 52 in strap 48, and extends from there through additional guides in an analogous way, as described hereinbefore and shown in FIG. 1, to nut 28 of driving arrangement 58. In nut 28, pulling element 30 is reversed again rearwardly, and after an intersection or cross-over extends in guide elements 40 around heel cap 20, and from there on both sides of the foot to top end region 38 of support element 18. In the area of the front part of the foot, pulling element 30 may be guided, again with an intersection or cross-over, in wedge 46, in each case to the other side of the foot, and extend from there to guides 52 in strap 48.

Stepping into the ski boot and the tightening of support element 18 and heel cap 20 takes place as follows: In order to step into ski boot 10, nut 28 is shifted into the area of the rearward end position by turning spindle 20 by means of adjusting motor 26. This release pulling element 30 and partial loops 32 and 34 are thereby enlarged. As a result of such enlargement of partial loops 32 and 34, adequate space is created for easily stepping into ski boot 10. Next, spindle 22 is turned in the opposite direction by means of adjusting motor 26, so that nut 28 is displaced in the lengthwise direction A towards the toe of the boot. This causes the two partial loops 32 and 34 to be pulled together, so that by means of support element 18 and heel cap 20, inner boot 16 will snugly come to rest against the skier's foot. In this way, a painless and safe fit of the foot in ski boot 10 is accomplished.

By guiding partial loop 34 around the foot and support element 18 to guide elements 40 on heel cap 20, and then guiding pulling element 30 with an intersection or cross-over, the elastically deformable heel cap 20 may be laterally forced against the heel in a direction substantially parallel with sole 14 and transverse relative to the lengthwise direction A of the boot, resulting in particularly good support within the heel area.

By means of set screw 54, the spacing between strap 48 and support element 18 transverse to sole 14 can be increased or decreased. If, for a lower instep, the length of spindle 22 is insufficent to adequately tighten pulling element 30, the spacing between strap 48 and support element 18 can be increased, thereby increasing the tension in pulling element 30. On the other hand, if the instep is high, strap 48 rests against support element 18. The adjustment of strap 48 with set screw 54 is required only once, as the stroke of spindle 22 is sufficiently large to permit stepping into the boot and tightening of support element 18 and heel cap 20 with a fixed length of pulling element 30.

Figure 3:
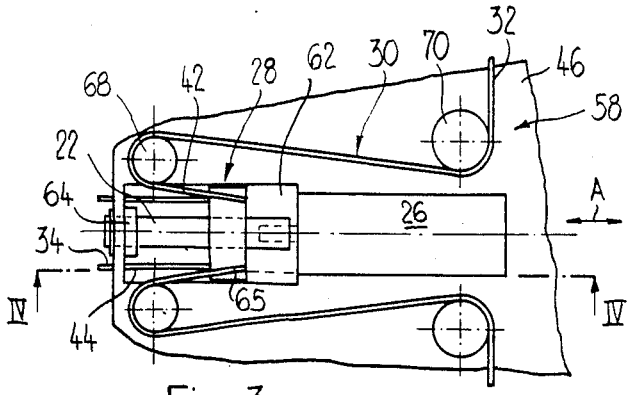
FIG. 3 is an enlarged top plan view of the driving arrangement in the boot sole shown in FIGS. 1 and 2.
Figure 4:
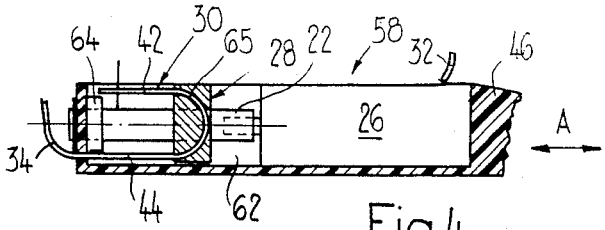
FIG. 4 is a cross-sectional view of the driving arrangement shown in FIG. 3 taken along the line IV—IV of FIG. 3.

FIGS. 3 and 4 show a top and a cross-sectional view of driving arrangement 58 arranged in wedge 46, with a cut along line IV—IV in FIG. 3. Within the area of driving arrangement 58, wedge 46 has a recess 62 substantially extending in the lengthwise direction A of the boot, in which recess adjusting motor 26 is accommodated and nut 28 is guided for positive rotation, but displaceable in the lengthwise direction A of the boot. Spindle 22 is connected for positive rotation with the shaft of adjusting motor 26 and, in its end region averted from adjusting motor 26, rotatably supported on wedge 46, but not displaceable in the lengthwise direction A of the boot. In this end region, spindle 22 is fitted with a rubber stop 64 preventing hard impacting of nut 28.

Nut 28 has two substantially circular segment-shaped grooves 65, in which pulling element 30 is guided. In recess 62, which is disposed removed from adjusting motor 26, reversing rollers 68 are rotatably supported on both sides of said recess, rotating around axles extending perpendicular to sole 14. Additional rollers 70 are rotatably supported laterally from recess 62 within the range of adjusting motor 26, said rollers also extending perpendicular to sole 14. Pulling element 30 of first partial loop 34 extends from heel cap 20 with its segments 44 approximately parallel with the lengthwise direction A of the boot to nut 28, is reversed there in the grooves 65 by 180°, and from there extends with segments 42, which belong to first partial loop 32, to reversing rollers 68, is guided around the latter, and then extends to reversing rollers 70 and from there outwardly transversely relative to the lengthwise direction A of the boot. Pulling element 30 is slidingly supported in nut 28, so that the sizes of the two partial loops 32 and 34 can compensate each other. Furthermore, provision may be made for limit switches within the region of recess 62 for switching off adjusting motor 26 as soon as nut 28 has reached a final position on spindle 22, so that the adjusting motor cannot be overloaded.

FIGS. 5 and 6 show front end region 36 of support element 18 in a lateral and sectional view, respectively, with a cut taken along line VI—VI in FIG. 5. Support element 18 has a length adjustment element 72 permitting adjustment of the length of pulling element 30. In a bulge 74 of support element 18, said bulge projecting from boot shaft 12, which is not shown in this figure, a worm wheel 76 is rotatably supported for rotation around an axis extending parallel with sole 14 and transversely relative to the lengthwise direction A of the boot. Worm wheel 76 is, by means of a flexible transmission member 78, actively connected with a rotary element (not shown) by means of which the worm wheel can be rotated in both senses of rotation. Pulling element 30 (cf. FIG. 1), within the region of first partial loop 32, is separated in the area of front end region 36 of support element 18. A first end 80 of the pulling element is fixed on support element 18 in the area of bulge 74. The second end 82 of the pulling element has a belt 84 with a toothing 86 extending transversely relative to the lengthwise extension of the belt. Belt 84 rests against support element 18 and is guided through bulge 74 by way of lateral openings 88 in the bulge. Toothing 86 cooperates with worm wheel 76 and, at the same time, holds the latter tight in bulge 74. By turning worm wheel 76, belt 84 is displaced in the direction of arrow B, resulting in an enlargement or reduction of the loop consisting of the two partial loops 32 and 34.

The mode of operation of the length adjustment element 74 is similar to the one of strap 48 in FIG. 2. By adjusting the size of the loop by means of length adjustment element 74 once, it is possible that a small length of spindle 22 will suffice, irrespective of the height of the instep, to permit stepping into ski boot 10 and to nevertheless pull support element 18 and heel cap 20 snugly fully against the foot.

It is obvious that a strap 48 (cf. FIG. 2) or a length adjustment element 72 (cf. FIGS. 5 and 6) can be dispensed with if spindle 22 has an adequate length. Also, it is possible to guide pulling element 30 in some other way. However, of importance is that the size of partial loops 32 and 34 can be increased or decreased by means of a single pulling part, i.e. nut 28. Pulling element 30 may be fixed in nut 28, which however, requires that the length of the partial loops be adjustable in at least one of the two partial loops 32 and 34, for example, by means of a bow strap 48 (cf. FIG. 2) or a length adjustment element 72 (cf. FIGS. 5 and 6) in order to fully force support element 18 or heel cap 20 against the foot, irrespective of its anatomy.

Instead of adjusting motor 26, spindle 22 may be actively connected, for example, with a flexible shaft connected with a rotary wheel actuated at the exterior of the boot. Such a rotary wheel may be arranged at any desired point on shaft 12. Furthermore, it is possible to displace a pulling part, which may have a design similar to the one of nut 28, by means of a lever system actuated from the outside of the boot.

Also, conceivably a pulling part may be moved by means of a pneumatic or hydraulic driving arrangement. For example, the pulling part may be connected with the piston of a piston-and-cylinder drive. A pump-and-valve arrangement for controlling such a piston-and-cylinder drive may be controllable on the boot shaft at the exterior of the boot.

With a ski boot 10 without a heel cap 20, the second partial loop 34 may be guided against the region of the heel by means of reversing elements preferably arranged on boot shaft 12, and reversed from there to driving arrangement 58.

Also, driving arrangement 58 with adjusting motor 26, spindle 22, nut 28 and reversing rollers 68 and 70 may be arranged in an insert adapted for insertion in wedge 46 or directly into sole 14.

While only a single embodiment of the present invention is shown and described, it will be obvious that many changes and modifications may be made thereunto without departing from the spirit and scope of the invention.

What is claimed is:

1. In a ski boot having a boot shaft and a sole, a support element arranged in an interior of the boot shaft covering a skier's instep in the form of a saddle, and a pulling element adapted to be tightened and released by means of a driving arrangement, said pulling element being guided across a front end region of the support element and running in a direction towards the sole and acting on the support element in a top end region thereof so as to pull said support element rearwardly, the improvement comprising the pulling element forming a single closed loop divided by the driving arrangement into first and second partial loops actively connected with the driving arrangement, the first partial loop being guided in the front end region of the support element and the second partial loop being guided in the top end region across the support element, the lengths of said first and second partial loops being simultaneously extended and reduced by means of the driving arrangement.

2. The ski boot as defined in claim 1, wherein the length of said closed loop is adjustable.

3. The ski boot as defined in claim 1, wherein segments of the partial loops are guided in the region of the driving arrangement substantially parallel with each other and preferably in the lengthwise direction of the boot parallel with a pulling member of the driving arrangement, said pulling member being displaceable substantially in the direction of said segments.

4. The ski boot as defined in claim 3, wherein said pulling element is reversed in the pulling member by substantially 180° at least once, and the segments of the partial loops lead away from the pulling part in pairs, each forming a segment of the first and second partial loops.

5. The ski boot as defined in claim 4, wherein said pulling element is slidingly guided in said pulling member.

6. The ski boot as defined in claim 5, wherein said pulling member includes a nut seated on a rotatable support spindle arranged in the boot sole, the axis of rotation of said spindle extending substantially parallel with the segments of said partial loops.

7. The ski boot as defined in claim 6, wherein said spindle is driven by means of a rotary wheel actively connected with the spindle by a flexible shaft, said wheel being actuated at the exterior of the ski boot.

8. The ski boot as defined in claim 6, wherein said spindle is driven by means of an electric motor.

9. The ski boot as defined in claim 5, wherein said pulling member is displaceable by means of a lever system actuated at the exterior of the boot.

10. The ski boot as defined in claim 1, wherein said pulling element extends in the region of the second partial loop from the top end region of the support element along both sides of the skier's foot to said heel cap gripping around the skier's heel from the back, and is guided to the driving arrangement while intersecting with or crossing-over itself within the region of the heel cap.

11. The ski boot as defined in claim 10, wherein said heel cap is elastically deflectable in a direction substantially parallel with the boot sole and transversely to the lengthwise direction of the boot, and is provided with guide elements for the pulling element.

12. The ski boot as defined in claim 11, wherein said heel cap is elastically deflectable in the lengthwise direction of the boot.

13. The ski boot a defined in claim 2 wherein said pulling element forming the closed loop is separated preferably in the region of the first partial loop and fixed at one end on the support element and at the other end actively connected with a length adjustment element arranged on the support element.

14. The ski boot as defined in claim 13, wherein said length adjustment element includes a rotatably supported worm wheel substantially rotating around an axis parallel with the boot sole and transversely to the lengthwise direction of the boot, said worm wheel acting on a belt with a toothing, said belt being fastened on said pulling element.

15. The ski boot as defined in claim 14, wherein said worm wheel is actively connected with a rotary element preferably by means of a flexible transmission member.

16. The ski boot as defined in claim 1, which further includes a strap gripping across said support element between the front and top end regions in a plane extending substantially transversely relative to the lengthwise direction of the ski boot, the spacing of said strap from said support element being adjustable in a direction transverse relative to the boot sole, said pulling element being guided from the driving arrangement to guides in the lateral ends of said strap and from there in the direction of the boot sole and to a reversing point, and from the latter around the front end region of the support element.

* * * * *